United States Patent [19]

Jaillet et al.

[11] 3,979,634

[45] Sept. 7, 1976

[54] TRAVELLING-WAVE TUBE WITH AN IMPROVED ELECTRON GUN

[75] Inventors: André Jaillet; André Pelletier; Jean-Pierre Thieulent, all of Paris, France

[73] Assignee: Thomson-CSF, Paris, France

[22] Filed: Nov. 7, 1974

[21] Appl. No.: 521,885

[30] Foreign Application Priority Data

Nov. 13, 1973 France ..... 73.40299

[52] U.S. Cl. ..... 315/3.5; 313/441; 313/451; 313/456

[51] Int. Cl.[2] ..... H01J 25/34

[58] Field of Search ..... 313/441, 451, 456, 442, 313/142; 315/3.5

[56] References Cited

UNITED STATES PATENTS

| | | | |
|---|---|---|---|
| 2,945,980 | 7/1960 | Geisler, Jr. | 315/3.5 |
| 2,984,762 | 5/1961 | Haas | 315/3.5 |
| 3,227,913 | 1/1966 | Disman et al. | 315/3.5 |
| 3,358,173 | 12/1967 | Meyerer et al. | 315/3.5 X |

*Primary Examiner*—Saxfield Chatmon, Jr.
*Attorney, Agent, or Firm*—Roland Plottel

[57] ABSTRACT

In order to reduce to a minimum the internal diameter of the focusing coils 30 of travelling-wave tubes, the electrodes of the electron gun 10 thereof terminate in cylindrical portions 26, 31 whose external surfaces are in contact, via rings 27 and 28, with metal washers 18, 19 separating insulating cylinders 14, 15, 16 stacked one on top of the other and forming a socket for the casing of the tube containing gun 10. The contact is such that the radial dimensions are minimal and high insulation can be provided between the components. Application to high-power, high-voltage travelling-wave tubes.

2 Claims, 3 Drawing Figures

Figure 3:
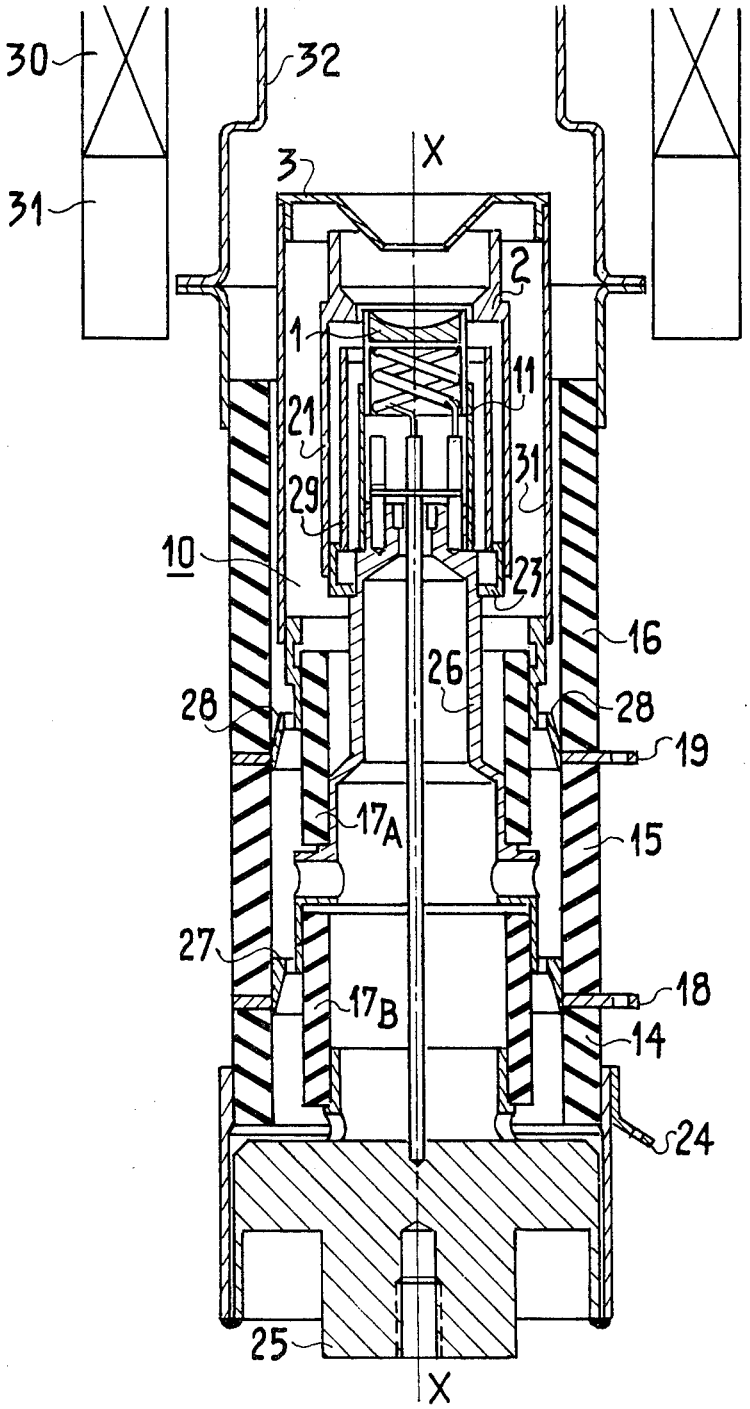

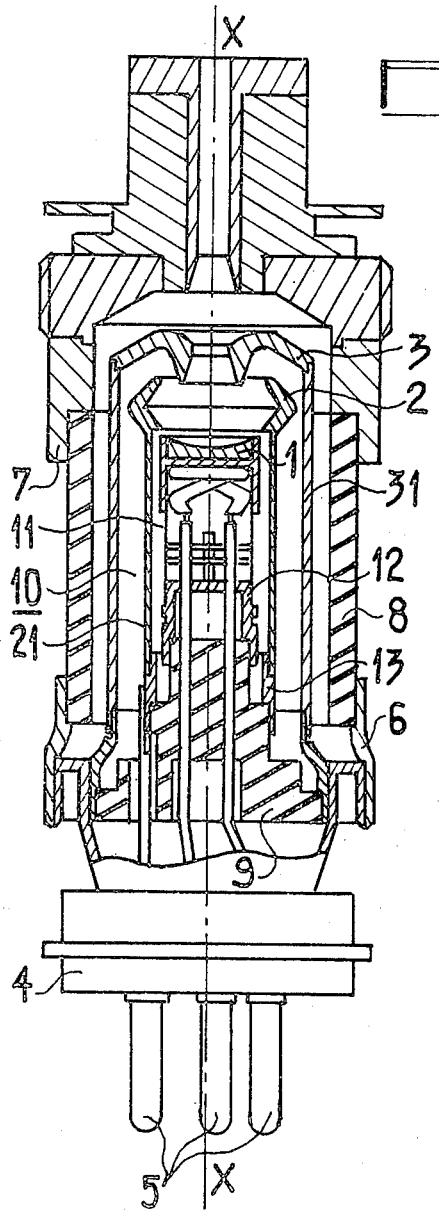
FIG. 1
FIG. 2
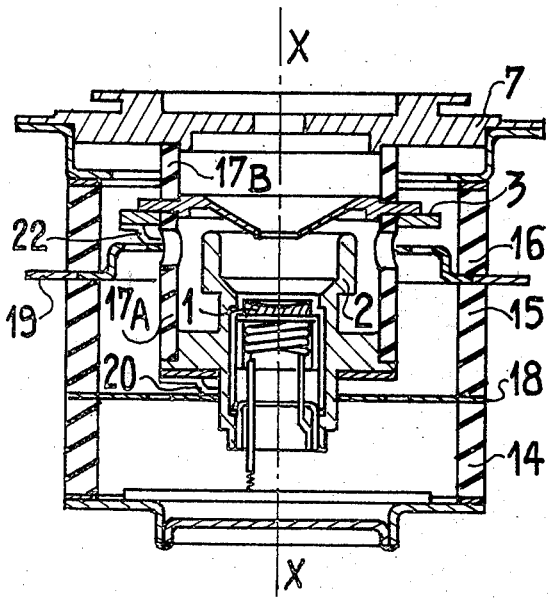

TRAVELLING-WAVE TUBE WITH AN IMPROVED ELECTRON GUN

The invention relates to an improved travelling-wave tube comprising an electron gun wherein the focusing coils can have a smaller diameter than in the prior art, for a given magnetic field along the tube axis.

In travelling-wave tubes, the beam of electrons from the electron gun is subjected to an axial magnetic field on its way to the collector. The purpose of the magnetic field is to prevent the beam from spreading along its path, more particularly along the delay line, before reaching and being captured by the collector.

As soon as the power applied to the tube exceeds a certain limit, the magnetic field has to be so intense that it can no longer be produced by permanent magnets as in the case of lower power travelling-wave tubes. Accordingly, use is made of conductive windings or coils which are centred on the tube axis and through which a d.c. flows; the magnetic focusing field is the resultant of the elementary magnetic field of each turn in the windings. It is a function of the number of turns and of the electric current travelling through them and is measured in ampere-turns/cm, i.e. a quantity proportional to the product of the number of turns per unit length of winding and the current flowing therethrough.

When the inner diameter of the windings increases, there is a very rapid increase in the number of ampere-turns required to obtain a given magnetic field along the tube axis. The minimum inner diameter is dependent on the diameter of the tube on which the turns are mounted. It is therefore desirable to reduce the aforementioned diameter in order to reduce the number of ampere-turns required for obtaining a given magnetic field along the axis, i.e. the radial bulkiness, more particularly the weight, of the windings.

The coils are threaded on to the tube, starting from one end thereof. In the case, however, of high-power travelling-wave tubes, the coils cannot be threaded on at the same end as the electron collector, owing to the size of the latter in view of the power to be dissipated and since, in most cases, there is a high-frequency output to a waveguide having large radial dimensions.

In the case of power tubes, therefore, the coils are threaded on to the tube from the end bearing the electron gun.

Consequently, the minimum inner diameter of the coils in power tubes is dependent on the dimensions of the gun, or rather the dimensions of the vacuum chamber containing the gun, which is larger than the rest of the tube casing, more particularly the part containing the delay line.

The invention relates to a travelling-wave tube comprising a gun designed so as to reduce the diameter of the winding. Furthermore, the design is such that the required high insulation can be provided between the gun components, in view of the high voltages involved.

According to the invention, there is provided a travelling-wave tube comprising a vacuum casing terminating at one end in an electron collector and secured in vacuum-tight manner at the other end to a socket closed by a tube base, the socket being made up of cylinders of insulating material stacked on top of one another with interposition of metal washers, the tube also comprising an electron gun disposed in the socket and comprising a cathode cooperating with electrodes to produce an electron beam which travels axially along the tube and is captured by the collector, characterised in that said cathode and said electrodes exhibit towards said socket extensions whose general shape is cylindrical and terminated by parts of frusto-conical shape, these parts being directly in contact by their external face with said washers.

The invention will be more clearly understood by referring to the following description and the accompanying drawings in which:

FIGS. 1 and 2 are cross-sections of two electron gun structures for prior-art travelling-wave tubes, and FIG. 3, likewise in section, illustrates the gun structure in tubes according to the invention.

All the drawings show structures of revolution around an axis XX, as is usually the case for travelling-wave tubes. The drawings show the electron gun and the adjacent components of the vacuum casing.

In all the drawings, reference 1 denotes the gun cathode, which is indirectly heated by a filament which is shown but not referenced. Reference 2 denoted a focusing electrode and reference 3 denotes a control electrode. Members 1, 2, 3 together form the electron gun 10. FIGS. 1 and 2 show two solutions adopted in the prior art.

FIG. 1 shows a device which can be called coaxial, wherein the aforementioned three electrodes have cylindrical parts 11, 21, 31 respectively, all having the axis XX, which connect components 1, 2, 3 to the tube exterior, via conductive passages 5 extending through an insulating tube base 4 as concerns the cathode (and also the filament) and the focusing electrode, and via an annular component 6 for the control electrode, in accordance with the well-known technology of thermionic tubes. In FIG. 1, reference 7 denotes an assembly of intermediate components disposed between a delay line (not shown) and the aforementioned gun; during operation, unit 7 is usually kept at the same potential as the delay line but it can also be brought to a different potential. Member 3 is insulated from member 7 by a spacer 8. An insulating component 9, secured to member 6, bears the filament, part 11 of the cathode and part 21 of the focusing electrode, via other metal components 12, 13 in the present example and various auxiliary small components in a manner well known in the prior art. Member 9 also bears the control electrode, as shown in the drawing. In the example shown in the drawing, member 9 has a substantially stepped structure so that it can act simultaneously as a support and an insulator. FIG. 1 also shows, however, that in a structure of the aforementioned kind, the insulation between components 1, 2 and 3 is limited by the dimensions of component 9 perpendicularly to axis XX. Accordingly, the structure has two disadvantages. Component 9 requires considerable machining, the difficulty being increased by the fact that it is usually made of ceramics and has to be re-worked and brought to the exact desired dimensions after baking. Furthermore, the coaxial structure of parts 11, 21, 31 loses all its advantage owing to the small radial dimensions of component 9, which limits the voltages which can be applied between cathode 1 and electrode 3, and consequently limits the power of the tube.

FIG. 2 shows a structure which was designed to obviate these disadvantages by providing axial insulation by means of insulating spacers 14, 15, 16 disposed outside spacers 17A and 17B, all of these spacers being made e.g. of ceramics as the aforementioned component 9. In FIG. 2, reference 7 denotes an assembly similar to the assembly referenced 7 in FIG. 1. We shall not give further details about this structure, since it is familiar to the thermionic tubes expert.

A structure of the aforementioned kind facilitates insulation, which can be increased as required by increasing the height of spacers 14, 15 and 16. As the drawing shows, however, the electrodes of the structure, more particularly the focusing electrode 2 and electrode 3, are connected to external connecting members 18, 19 via springs 20, 22, spring 20 being disposed between electrode 2 and component 18 and spring 22 disposed between electrode 3 and component 19; both the springs are flattened between the aforementioned components. In order to obtain sufficient pressure to ensure good contacts, components 2, 3 must be solid and have large radial dimensions, i.e. perpendicular to axis XX. This is not a disadvantage in the case of low-power travelling-wave tubes. In the case, however, of high-power tubes, this increases the difficulty, for the aforementioned reasons, of constructing a gun having a small radial bulk.

FIG. 3 shows the gun end of a travelling-wave tube according to the invention.

As in the example in FIG. 1, the bottom ends of cathode 1, focusing electrode 2 and control electrode 3 terminate in thin cylindrical metal skirts 11, 21 and 31 respectively. The part of the vacuum casing surrounding the gun is constructed by stacking cylindrical components 14, 15, 16 separated by metal washers 18, 19 in the same manner as in FIG. 2. At the top of FIG. 3, the aforementioned part of the vacuum casing terminates in a component (not referenced) which connects the aforementioned part or socket to the rest of the tube, which is not shown since it is not relevant to the invention.

In the example shown in the drawing, cathode 1 and focusing electrode 2 form a single box as shown, which is closed by an end member 23 and which is all at the same potential, equal to that of the thin skirt 11 in which the cathode terminates at the bottom. The assembly is mounted in accordance with known thermionic tubes technology. Note that a metal component 24 welded to a conductive tube base 25 provides a connection to one end of the filament, the other end of which is connected to the cathode box.

Skirt 11 is prolonged by a stepped cylindrical component 26 and is spot-welded thereto in known manner. References 17A and 17B denote two insulating spacers.

In tubes according to the invention, the assembly comprising the cathode and the focusing electrode is in electric contact with connection 18 via a component 27 which, in the example shown in FIG. 3, comprises a frustoconical ring forming a spring in contrast to the prior-art structures as shown in FIG. 2, where springs 20, 22 are disposed flat between the components which they maintain in contact. In the example described, spring 27 forms an integral part of component 26. In an alternative embodiment, spring 27 can be attached and welded to component 26. In the drawing, 29 denotes a heat shield. Similarly, part 31 of control electrode 3 is in electric contact with connection 19 via a component 28 connected to skirt 31, e.g. by spot-welding. Component 28, like component 27, comprises a frusto-conical ring forming a spring and maintaining skirt 31 of electrode 3 in contact with connection 19. Components 27, 28 are both made e.g. of an iron nickel cobalt alloy commercially known as Kovar. The rings can either be in one piece or made up of a number of separate parts. The apertures provided in components 27 and 28, like those appearing at other places in the drawing, are adapted to facilitate evacuation of the tube. As in the examples shown in the other two drawings, we have deliberately avoided mentioning certain auxiliary components which are conventionally used in all thermionic tubes and are shown without reference numbers in the drawings. In the drawings, references 30, 33 and 32 respectively denote the end portion of the focusing device and the end portion of the rest of the casing (reference 30 applies to the windings and 33 applies to the pole-pieces).

Owing to the aforementioned annular springs 27, 28 the electron-gun components are kept in contact with the connections along the lateral surface of the rings, without increasing the radial dimensions.

In one application of the invention, a travelling-wave tube was constructed to operate in the 5.9–6.4 GHz band at a high voltage of 10 kV with a winding assembly having a total weight of approx. 11 kg for an axial magnetic field of 2,000 Gauss over a length of 240 mm. The total weight of the focusing system including magnetic shielding did not exceed 20 kg. The output high-frequency power was 1 kW in steady operation. Equivalent prior-art constructions would require focusing system having at least double the weight.

Of course, the invention applies even more to low-power travelling-wave tubes, although it is less necessary in such cases.

What is claimed is:

1. A travelling-wave tube comprising a vacuum casing terminating at one end in an electron collector and secured in vacuum-tight manner at the other end to a socket closed by a tube base, the socket being made up of cylinders of insulating material stacked on top one another in axial alignment with interposition of metal washers, whose external diameter is substantially flush with said insulating cylinders, and which are used as contacts for the sources which energize the tube in operation, said tube further comprising an electron gun disposed in said socket, which gun is comprised of a cathode and electrodes cooperating with said cathode to produce an electron beam which travels axially along said axis and is collected by said collector, said cathode and electrodes have extensions of cylindrical shape and are mounted in insulated relation by spacers of cylindrical shape in axial alignment around said axis and located inside said insulating cylinders, and wherein said cathode and electrode cylindrical extensions are provided with frusto-conical portions, acting as springs, resting by their external surface against said washers in order to insure an electrical contact between said cathode and electrodes and said washers.

2. A travelling-wave tube according to claim 1, characterised in that said frusto-conical portions are made up of a number of separate parts.

* * * * *